US005347467A

United States Patent [19]

Staroselsky et al.

[11] Patent Number: 5,347,467

[45] Date of Patent: Sep. 13, 1994

[54] LOAD SHARING METHOD AND APPARATUS FOR CONTROLLING A MAIN GAS PARAMETER OF A COMPRESSOR STATION WITH MULTIPLE DYNAMIC COMPRESSORS

[75] Inventors: Naum Staroselsky; Saul Mirsky, both of West Des Moines, Iowa; Paul A. Reinke, Elkhart, Ind.; Paul M. Negley, Urbandale; Robert J. Sibthorp, Ankeny, both of Iowa

[73] Assignee: Compressor Controls Corporation, Des Moines, Iowa

[21] Appl. No.: 902,006

[22] Filed: Jun. 22, 1992

[51] Int. Cl.[5] ..... F04D 27/02; G04B 13/02

[52] U.S. Cl. ..... 364/510; 364/431.02; 417/5; 415/1

[58] Field of Search ..... 364/510, 505, 431.02; 290/40; 417/3, 4, 5; 415/1

[56] References Cited

U.S. PATENT DOCUMENTS

| | | | |
|---|---|---|---|
| 4,142,838 | 3/1979 | Staroselsky | 417/20 |
| 4,494,006 | 1/1985 | Staroselsky et al. | 415/1 |
| 4,640,665 | 2/1987 | Staroselsky et al. | 290/4 |
| 4,949,276 | 8/1990 | Staroselsky et al. | 364/509 |
| 5,108,263 | 4/1992 | Blotenberg | 417/2 |
| 5,195,875 | 3/1993 | Gaston | 417/282 |

*Primary Examiner*—Thomas G. Black
*Assistant Examiner*—Michael Zanelli
*Attorney, Agent, or Firm*—Henderson & Sturm

[57] ABSTRACT

A method and apparatus for maintaining a main process gas parameter such as suction pressure discharge pressure, discharge flow, etc. of a compressor station with multiple dynamic compressors, which enables a station controller controlling the main process gas parameter to increase or decrease the total station performance to restore the main process gas parameter to a required level, first by simultaneous change of performances of all individual compressors, for example, by decreasing their speeds, and then after operating points of all machines reach their respective surge control lines, by simultaneous opening of individual antisurge valves. In the proposed load-sharing scheme, one compressor is automatically selected as a leading machine. For parallel operation, the compressor which is selected as the leader is the one having the largest distance to its surge control line. For series operation, the leader has the lowest criterion "R" value representing both the distance to its surge control line and the equivalent mass flow rate through the compressor. The leader is followed by the rest of the compressors, which equalize their distances to the respective surge control lines or criterions "R" with respect to that of the leader.

9 Claims, 4 Drawing Sheets

LOAD SHARING METHOD AND APPARATUS FOR CONTROLLING A MAIN GAS PARAMETER OF A COMPRESSOR STATION WITH MULTIPLE DYNAMIC COMPRESSORS

TECHNICAL FIELD

The present invention relates generally to a method of control and a control apparatus for maintaining a main process gas parameter such as suction pressure, discharge pressure, discharge flow, etc. of a compressor station with multiple dynamic compressors, which enables a station control system, controlling the main process gas parameter to increase or decrease the total station performance to restore the main process gas parameter to a required level, first by simultaneous change of performances of all individual compressors, for example, by decreasing their speeds, and then after operating points of all machines reach their respective surge control lines, by simultaneous opening of individual antisurge valves.

In the proposed load-sharing scheme, one compressor is automatically selected as a leading machine. For parallel operation, the compressor which is selected as the leader is the one having the largest distance to its surge control line. For the series operation, the leader has the lowest criterion "R" value representing both the distance to its surge control line and the equivalent mass flow through the compressor.

The leader is followed by the rest of the compressors, which equalize their distances to the respective surge control lines or criterions "R" with respect to that of the leader.

In the proposed scheme, the station control system can decrease the performance of each compressor only until the compressor is in danger of surge. After such danger appears, the main process gas parameter is controlled by controlling the antisurge valves to change the flow through the process.

BACKGROUND ART

The present invention relates generally to control methods and control devices for controlling compressor stations, and more particularly to the methods and apparatuses for controlling parallel and series operated dynamic compressors.

All known control systems for parallel working compressors and for compressors working in series can be divided into two categories. In the first category, the antisurge protective devices and the control device for controlling the station gas parameter are independent and not connected at all to each other. The station control device changes the performances of individual compressors by establishing the preset gains and biases which remain constant during station operation. For some compressors, the gains are equal to zero and the biases are set to provide for a baseload operation, with a constant and often maximum speed. This category of control system can not cope with two major problems.

The first problem is associated with the necessity to vary the gains and biases for load sharing device set-points, for optimum load-sharing under changes of station operating conditions, such as inlet conditions or deterioration of some machines. The second problem is associated with possible interactions between the station control device and the antisurge control devices of individual compressors under conditions when the process flow demand is continuously decreasing. It is very usual for this category of control system to operate one compressor far from surge while keeping one or more compressors dangerously close to surge, including premature antisurge flow to prevent surge.

In the second control system category, there is a cascade combination of the station control device and the load-sharing devices of individual machines. In this category, the station control device manipulates the set points for the distances between the individual operating points and the respective surge limits.

If, for the parallel operation, some stabilization means is effective to make such cascade approach workable, then for series operation it will not work at all. But even for parallel operation, the above identified stabilization means degrades the dynamic precision of control.

To overcome the aforementioned problems, the dynamic control of compressors may be significantly improved for both parallel and series operated machines by eliminating cascading but still providing for equalization of relative distances to the respective surge control lines. It can be even further improved by providing special interconnection between all control loops to eliminate dangerous interactions in the vicinity of surge.

DISCLOSURE OF THE INVENTION

A main purpose of this invention is to enable operating points of all compressors working simultaneously to reach their respective surge control lines before control of the main process gas parameter is provided by wasteful antisurge flow, such as recirculation.

Another purpose of this invention is to enable the control system to provide for stable and precise control of the main process gas parameter while providing for effective antisurge protection and optimum load sharing between simultaneously working compressors.

The main advantages of this invention are: an expansion of safe operating zone without recirculation for each individual compressor and for the compressor station as a whole; a minimization or decoupling of loop interaction; and an increase of the system stability and speed of response.

According to the present invention, each dynamic compressor of the compressor station is controlled by three interconnected control loops.

The first loop controls the main process gas parameter common for all compressors operating in the station. This control loop is implemented in a station controller which is common for all compressors. The station controller is capable of manipulating sequentially first a unit final control for each individual compressor, such as a speed governor, an inlet (suction) valve, a guide valve etc., and then each individual antisurge final control device, such as a recycle valve.

The second control loop provides for optimum load sharing. This loop is implemented in a unit controller, one for each compressor. The unit controller enables the compressor operating point to reach the respective surge control line simultaneously with operating points of other compressors and before any antisurge flow, such as recirculation, starts. The output of the unit controller for each individual compressor is interconnected with the output of the station controller common to all compressors, to provide a set-point for the position of the unit final control device.

A third control loop is implemented in an antisurge controller which computes the relative distance to the surge control line, prevents this distance from decreasing below zero level and transmits this distance to the companion unit controller. The output of the antisurge controller is interconnected with the output of the station controller to manipulate the position of the antisurge final control device.

The interconnection between all three control loops, which contribute to the operation of each individual machine, is provided in the following way:

The set-point for the unit final control device of the $i^{th}$ individual compressor is manipulated by both the station controller and the respective unit controller, however, the output of the station controller can increase or decrease said set-point only when the relative distance to the respective surge control line $d_{ci}$ is higher than or equal to the preset value "$r_i$." It can only increase said set-point when $d_{ci}<r_i$.

The set point for the position of each respective antisurge final control device can be manipulated either by respective antisurge controllers or by the station controller. The antisurge final control device can be closed only by the antisurge controller. It can, in one implementation, be opened by either one, whichever requires the higher opening, when $d_{ci}<r_i$. Alternatively, in a second implementation, the corrective actions of both the antisurge controller and the station controller can be added together when both require the antisurge final control device to be opened, and the result used to open the antisurge final control device when $d_{ci}<r_i$.

The optimum load-sharing between parallel working compressors is provided in the present invention by the following way:

Each unit controller receives the relative distance to the respective surge control line computed by companion antisurge controller and compares said distance with the largest relative distance selected by the station controller between all compressors being in parallel operation. The compressor with the largest relative distance to its respective surge control line is automatically selected as a leader. The set-point for the leader's unit final control device is manipulated only by the station controller.

The set-points for the unit final control devices of the remainder of the compressors in the parallel system are manipulated to equalize their relative distances to the respective surge control lines with that of the leader, in addition to being manipulated by said station controller to control the main process gas parameter common for all compressors.

For the series operation of the compressors, the unit controller for the $i^{th}$ compressor computes a special criterion "$R_i$" value which represents both the relative distance to the surge control line for the $i^{th}$ compressor and the equivalent mass flow rate through the $i^{th}$ compressor. The unit controller controls the load sharing for the associated compressor by equalizing its own criterion $R_i$ value with the minimum criterion $R_{min}$ value of the leader compressor, which was selected by the station controller.

Similarly, as with parallel operating compressors, a leader compressor is selected and the rest of the compressors follow the leader. For series compressors, however, they do so by equalizing their criterion $R_1$ values with that of the leader.

An object of the present invention is to prevent the wasteful gas flow through the antisurge final control device, such as recirculation, for purposes of controlling the main process gas parameter, until all load-sharing compressors have reached their respective surge control lines. This is done by equalizing the relative distances to the respective surge control lines for parallel operating compressors and by equalizing the criterion "R" values representing both the relative distance to the respective surge control line and the equivalent mass flow rate through the compressor for compressors operated in series. The equivalent mass flow compensates for flow extraction or flow admission between the series operated machines.

Another object of the present invention is to prevent interaction among control loops controlling the main process gas parameter of the compressor station with the antisurge protection of each individual compressor.

Other objects, advantages, and novel features of the present invention will become apparent from the following detailed description of the invention when considered in conjunction with the accompanying drawings.

BRIEF DESCRIPTION OF THE DRAWINGS

FIG. 1 is comprised of FIG. 1(*a*) and 1(*b*) and FIG. 2 is comprised of FIG. 2(*a*) and 2(*b*).

BEST MODE FOR CARRYING OUT THE INVENTION

Figure 1A:
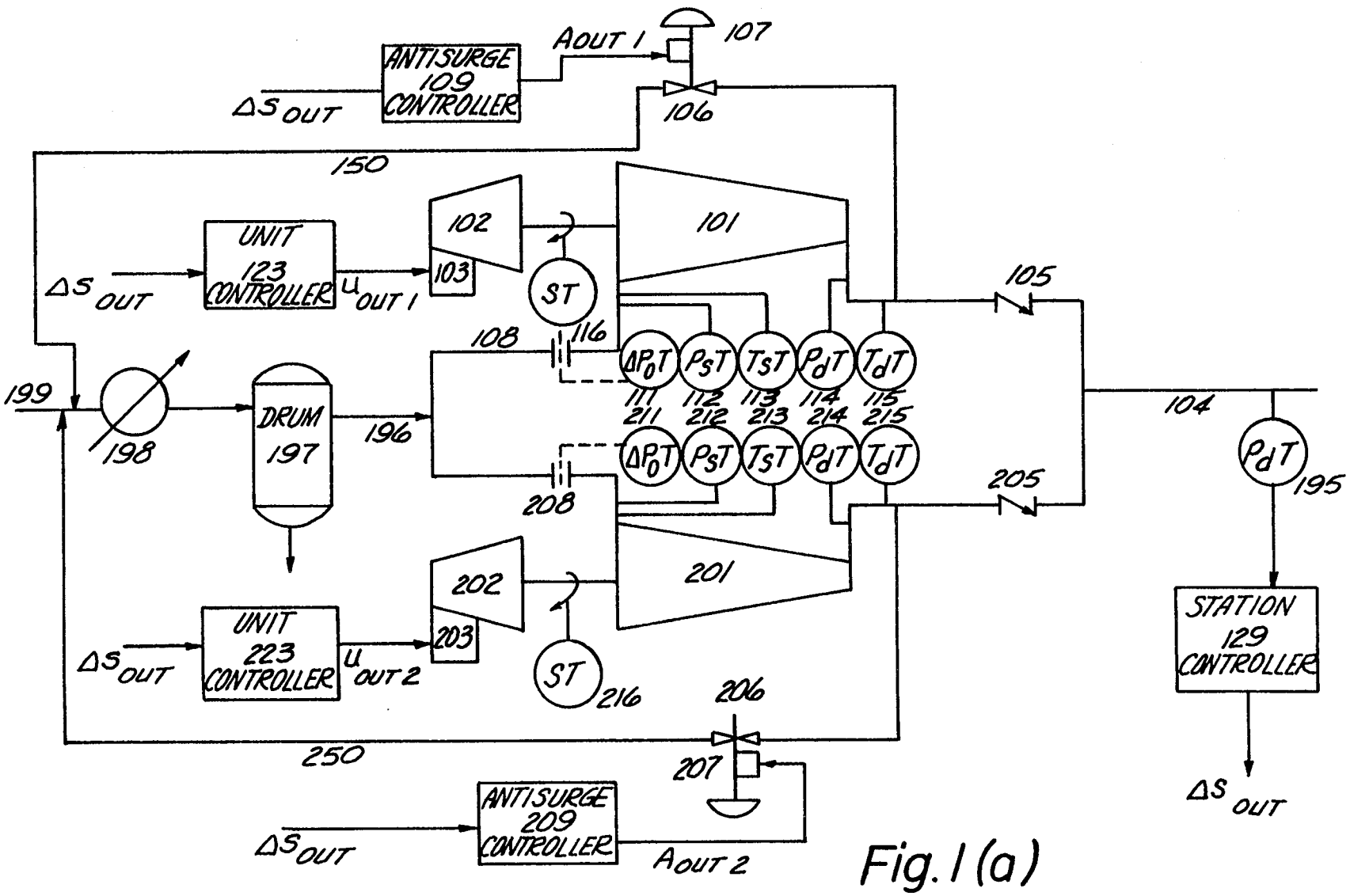
FIG. 1 and FIG. 2, respectively, present the schematic diagrams of control systems for compressor stations with dynamic compressors, operating in parallel and for compressor stations with dynamic compressors operating in series.
Figure 1B:
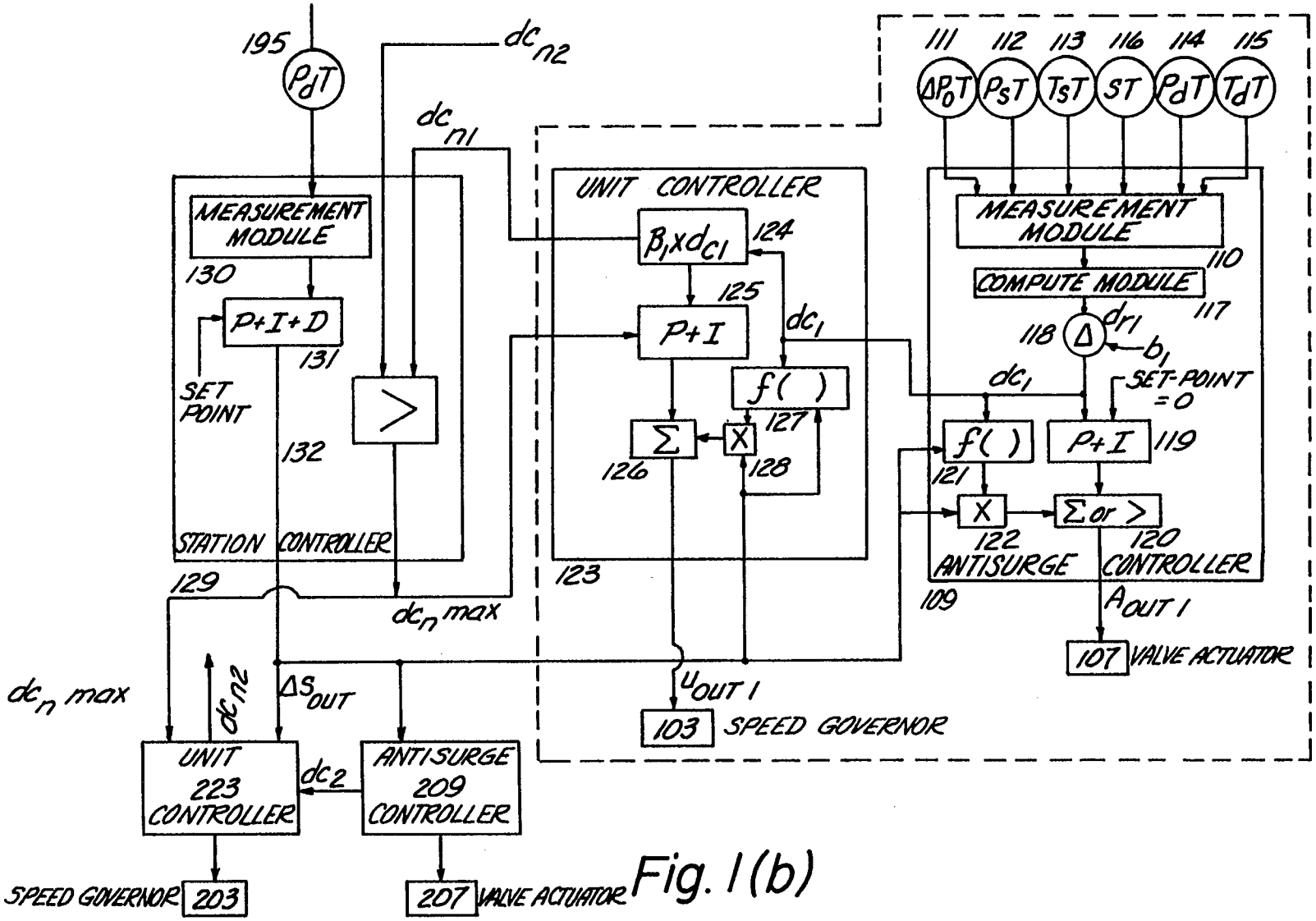

Referring now to the drawings wherein like reference numerals designate identical or corresponding parts throughout the several views, FIG. 1(*a*) shows two parallel working dynamic compressors (101) and (201), driven each by a steam turbine (102) and (202), respectively, and pumping the compressed gas to a common discharge manifold (104) through the respective non-return valves (105) and (205). Each compressor is supplied by a recycle valve (106) for compressor (101) and (206) for compressor (201) with respective actuators with positioners (107) and (207). The steam turbines have the speed governors (103) and (203) respectively, controlling the speed of respective dynamic compressors. Each compressor is supplied by a flow measuring device (108) for compressor (101) and (208) for compressor (201); transmitters (111), (112), (113), (114), (115) and (116) are provided for measuring differential pressure across a flow element in suction (108), suction pressure, suction temperature, discharge pressure, discharge temperature and rotational speed respectively for compressor (101); and transmitters (211), (212), (213), (214), (215) and (216) are provided for measuring differential pressure across a flow element in suction (208), suction pressure, suction temperature, discharge pressure, discharge temperature and rotational speed respectively for compressor (201).

Both recirculation lines (150) and (250) feed into a common suction manifold (199) which receives gas from the upstream process and passes the gas through common cooler (198) and common knockout drum (197) to common manifold (196).

Both compressors (101) and (201) are supplied by a station control system providing for pressure control in the common manifold (104) and also for optimum load-sharing and antisurge protection of individual compressors.

The control system consists of: one common station controller (129) controlling the main process gas parameter (discharge pressure in this example) measured by a pressure transmitter (195), using calculated corrective signal $\Delta S_{out}$; two unit controllers (123) and (223) for compressors (101) and (201) respectively, which control the performance of each compressor by controlling the set-points $U_{out}$ and $U_{out2}$ to speed governors (103) and (203) respectively; and two antisurge controllers (109) and (209) for compressors (101) and (201) respectively, which manipulate the set-points $A_{out1}$ and $A_{out2}$ of positioners (107) and (207) for recycle valves (106) and (206) respectively.

Referring to FIG. 1(*b*), the two antisurge controllers (109) and (209), one each per respective compressor, are each comprised of seven control modules: measurement module (110) for compressor (101) and (210) for compressor(201), each receiving signals from six transmitters (111), (112), (113), (114), (115) and (116) for compressor (101) and (211), (212), (213), (214), (215) and (216) for compressor (201); computational module (117) for compressor (101) and (217) for compressor (201); comparator module (118) for compressor (101) and (218) for compressor (201); P+I control module (119) for compressor (101) and (219) for compressor (201); output processing module (120) for compressor (101) and (220) for compressor (201); nonlinear functional module (121) for compressor (101) and (221) for compressor (201) and multiplier module (122) for compressor (101) and (222) for compressor (201).

The two unit controllers (123) and (223), one per respective compressor, are each comprised of five control modules: normalizing module (124) for compressor (101) and (224) for compressor (201) , P+I control module (125) for compressor (101) and (225) for compressor (201) , summation module (126) for compressor (101) and (226) for compressor (201) , nonlinear functional module (127) for compressor (101) and (227) for compressor (201) and multiplier module (128) for compressor (101) and (228) for compressor (201).

The station controller (129) is common for both compressors and is comprised of three control modules: measurement module (130) receiving a signal from pressure transmitter (195); P+I+D control module (131), and selection module (132).

Because the antisurge controllers (109) and (209) and the unit controllers (123) and (223) are absolutely identical, an interconnection between their elements may be described by the example only for compressor (101).

The computational module (117) of the antisurge controller (109) of compressor (101) receives the data collected from the six transmitters by measurement module (110); pressure differential transmitter (111) across the flow measuring device (108), suction pressure and temperature transmitters, (112) and (113) respectively, discharge pressure and temperature transmitters (114) and (115), respectively, and speed transmitter (116). Based on data collected, the computational module (117) computes a relative distance $d_{r1}$ of the operating point of compressor (101) to its respective surge limit line, said relative distance may be for example computed as:

$$d_{r1} = 1 - \frac{K \cdot \frac{(R_c^{\sigma} - 1)}{(\sigma)} \cdot f(N)}{\frac{\Delta P_o}{P_s}} \tag{1}$$

where: f(N) represents the variation of the slope of the respective surge limit with variation of speed (N) of compressor (101), $R_c$ is the compression ratio produced by compressor (101), $\Delta P_o$ is the pressure differential across the flow measuring device in suction, $P_s$ is the suction pressure, $\sigma$ is the polytropic exponent for compressor (101), and K is a constant for gas with constant molecular weight and compressibility.

The compression ratio $R_c$ in its turn is computed as:

$$R_c = \frac{P_d}{P_s} \tag{2}$$

where $P_d$ and $P_s$ are in absolute units; and exponent $\Gamma$ is computed using the law of polytropic compression:

$$\frac{T_d}{T_s} = \left(\frac{P_d}{P_s}\right)^{\sigma} \tag{3}$$

yielding $$\sigma = \frac{\log R_T}{\log R_c} \tag{4}$$

where: $R_T$ is the temperature ratio:

$$R_T = \frac{T_d}{T_s} \tag{5}$$

with $T_d$ and $T_s$ being the discharge and suction temperatures respectively in absolute units.

Based on computed said relative distance $d_{r1}$ to the surge limit line the comparator module (118) calculates the relative distance $d_{c1}$ to the respective surge control line:

$$d_{c1} = d_{r1} - b_1 \tag{6}$$

where $b_1$ is the safety margin between respective surge limit and surge control lines.

The P+I control module (119) has a set-point equal to 0. It prevents the distance $d_{c1}$ from dropping below positive level by opening the recycle valve (106). The valve (106) is manipulated with an actuator by positioner (107) which is operated by output processing module (120) of antisurge controller (109). The output processing module (120) can be optionally configured as a selection module or a summation module. As a selection module, module (120) selects either the incremental change of P+I module (119) or the incremental change of multiplier (122), whichever requires the larger opening of valve (106). As a summation module, the incremental changes of both the P+I module (119) and the multiplier module (122) are summed. The multiplier module (122) multiplies the incremental change $\Delta S_{out}$ of the P+I+D control module (131) of the station controller (129) by nonlinear function (121) of the relative distance $d_{c1}$ and station controller corrective signal $\Delta S_{out}$. The value of this non-linear function can be equal to value $M_{11}$, value $M_{12}$ or zero. This value is always equal to zero, except when $d_{c1} < r_1$ and $\Delta S_{out} > 0$, in which case it is equal to value $M_{11}$; or when $d_{c1} < r_1$ and $\Delta S_{out1} < 0$, in which case it is equal to $M_{12}$.

The unit controller (123) and (223) are also absolutely identical, and operation of both can be sufficiently described using the example only of unit controller (123).

The relative distance $d_{c1}$ is directed to unit controller (123) where the normalizing module (124) multiplies the relative distance $d_{c1}$ computed by antisurge controller (109) by a co-efficient $\beta_1$. The purpose of such normalization is to either position the operating point of compressor (101) under its maximum speed and required discharge pressure in such a way that $$d_{cn1}=\beta_1 \cdot d_{c1}=1 \quad (7)$$

at its maximum, or to position each operating point at its maximum efficiency zone under the most frequent operational conditions. The coefficient $\beta_1$ may also be dynamically defined by a higher level optimization system.

The output of normalizing module (124) is directed to selection module (132) of station controller (129) and to P+I control module (125) of unit controller (123). Selection module (132) selects $d_{cmax}$ as the highest value between $d_{cn1}$ and $d_{cn2}$ for compressors (101) and (201) respectively, and sends this highest value as the set-points to P+I modules (125) and (225) of respective unit controllers (123) and (223).

If the $d_{cnmax}$ value selected by module (132) is $d_{cn1}$, compressor (101) automatically becomes the leader. Its P+I module (125) produces then the incremental change of the output equal to 0. As a result, the summation module (126) is operated only by the incremental changes of the output $\Delta S_{out}$ of the P+I+D module (131) of station controller (129), provided non-linear function (127) is not equal to zero. If module (132) selects the normalized distance $d_{cn2}$, then the P+I module (125) of unit controller (123) equalizes its own normalized distance $d_{cn1}$, to that of compressor (201) which automatically becomes the leader.

In this case, the summation unit (126) changes its output based on the incremental changes of two control modules: P+I module (125) of unit controller (123) and P+I+D module (131) of station controller (129). Because of the nonlinear function produced by functional control module (127), the incremental change $\Delta S_{out}$ of the P+I+D module (131) is multiplied by module (128) either by a value equal to $M_{13}$, $M_{14}$ or by zero.

When relative distance $d_{c1}$ is higher than or equal to value "$r_i$," the multiplication factor is always equal to $M_{13}$. It is equal to $M_{14}$ when $d_{c1}<r_1$, and the incremental change $\Delta S_{out}$ of the output of the module (131) is greater than zero. However, when $d_{c1}<r_1$ and the incremental change $\Delta S_{out}$ of the output of the module (131) is less than or equal to zero, then the multiplication factor is equal to zero. This means that while controlling the discharge pressure in common manifold (104), the station controller cannot decrease the relative distance $d_{c1}$ to its respective surge control line for common compressor (101) below some preset level "$r_1$."

The output of summation module (126) of unit controller (123) manipulates the set-point $U_{out1}$ for speed governor (103).

Station controller (129) changes the incremental output $\Delta S_{out}$ of its P+I+D control module (131) to maintain the pressure measured by transmitter (195) in common discharge manifold (104).

The operation of the control system presented by FIG. 1 may be illustrated by the following example. Let us assume that initially both compressors (101) and (201) are operated under the required discharge pressure in common manifold (104) and with completely closed recycle valves (106) and (206). The normalized relative distances $d_{cn1}$ and $d_{cn2}$ of their operating points to the respective surge control lines are equal to the same value, say "2". Assume further that process demand for flow decreases in common manifold (104). As a result, the pressure in manifold (104) starts to increase. The normalized distance $d_{cn1}$ of compressor (101) to its surge control line decreases to the value $A_1$. And for compressor (201) the value of its normalized relative distance $d_{c,n2}$ decreases from the value 2 to the value $A_2$. Also, assume that $A_1>A_2$ and both relative distances $d_{cn1}$ and $d_{cn2}$ are greater than their respective preset values "$r_1$" and "$r_2$."

Selection module (132) selects the value of $d_{cn1}$ as the set-point $d_{cnmax}$ for control modules (125) and (225) of unit controllers (123) and (223), respectively. The compressor (101) has therefore been automatically selected as the leader.

Since $d_{cn1}>r_1$, the nonlinear function (127) is equal to $M_{11}$ and summation module (126) of unit controller (123) receives through the multiplier (128) the incremental decreases $\Delta S_{out}$ of output of P+I+D module (131) multiplied by $M_{11}$, which is required to restore the pressure in the manifold (104) to the required level. Said incremental decreases of the output of P+I+D module (131) decrease the set-point of speed governor (103) for the turbine (102), decreasing the flow through compressor (101). Simultaneously, summation module (226) of unit controller (223) of compressor (201) changes the set-point of speed governor (203) for compressor (201) under the influence of both: the incremental changes of the output of control module (131) of station controller (129) and changes of the output of P+I control module (225) of unit controller (223) of compressor (201).

The transient process continues until both distances $d_{c1n}$ and $d_{c2n}$ are equalized and the pressure in discharge manifold (104) is restored to the required level.

Assume again that the process flow demand decreases further and the speed of each individual compressor is decreased until $d_{cn1}=d_{cn2}=0$. Any further decrease of flow demand will cause the beginning of the opening of both recycle valves (106) and (206) by control modules (119) and (219) of antisurge controllers (109) and (209) through output process modules (120) and (220) respectively, to keep the operating points on their respective surge control lines.

Further decrease of flow demand will increase the discharge pressure again and: the distances $d_{cn1}$ and $d_{cn2}$ will decrease below levels $r_1$ and $r_2$, respectively; and station controller (129) will lose its ability to decrease the speeds of compressors (101) and (201). Instead it will start to send the incremental changes $\Delta S_{out}$ of the output of its P+I+D control module (131) to the output processing modules (120) and (220) of antisurge controllers (109) and (209), through multiplier modular (122) and (222), respectively. If the output processing modules (120) and (220) perform a selection function, and if these incremental changes $\Delta S_{out}$ require more opening of recycle valves (106) and (206), than required by modules (119) and (219), then the recycle valves will be opened by the $\Delta S_{out}$ incremental changes to restore the pressure to the required level. If the output processing modules (120) and (220) perform a summation function, then the incremental changes of both will be combined to open the recycle valves (106) and (206) to restore the pressure to the required level. As soon as distances $d_{cn1}$ and $d_{cn2}$ become higher than preset levels $r_1$ and $r_2$, respectively, the P+I+D control module (131) of station controller (129) will function through unit controllers (123) and (223) to decrease the speeds of both individual compressors. This process will continue until the pressure in the common discharge manifold (104) will be restored to its required level.

Assume further that the flow demand increases. As a result, pressure in manifold (104) drops and distances $d_{cn1}$ and $d_{cn2}$ become positive. The station controller (129) through its P+I+D module (131) will start to immediately increase the speed of both compressors (101) and (201). At the same time, the antisurge controllers through their respective P+I modules (119) and (219) will start to close the recycle valves (106) and (206). Assume also that distance $d_{cn2}$ becomes higher than $d_{cn1}$. As a result, the compressor (201) automatically will become the leader. The P+I module (125) of unit controller (123) will speed up compressor (101) adding to the incremental increase of the output of the P+I+D module of station controller (129). As a result, both compressors will equalize their distances $d_{cn1}$ and $d_{cn2}$. If, as a result of reaching its maximum speed, compressor (201) will not be capable of decreasing its respective distance $d_{cn2}$, this limited compressor (201) will be eliminated from the selection process. As a result, compressor (101) will be automatically selected as the leader, giving the possibility for station controller (129) to increase the speed of compressor (101) and to restore the station discharge pressure to the required level.

Figure 2A:
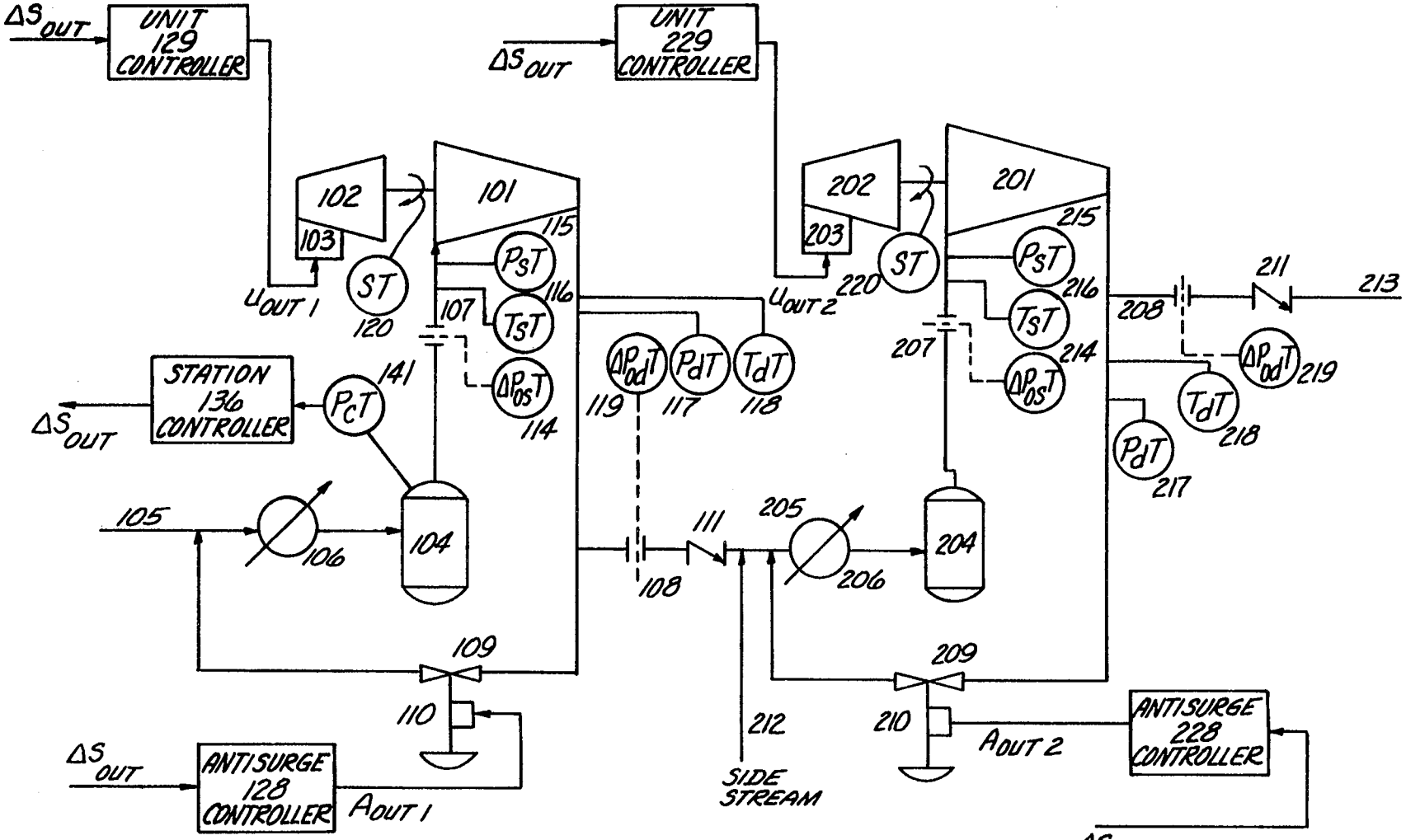
Figure 2:
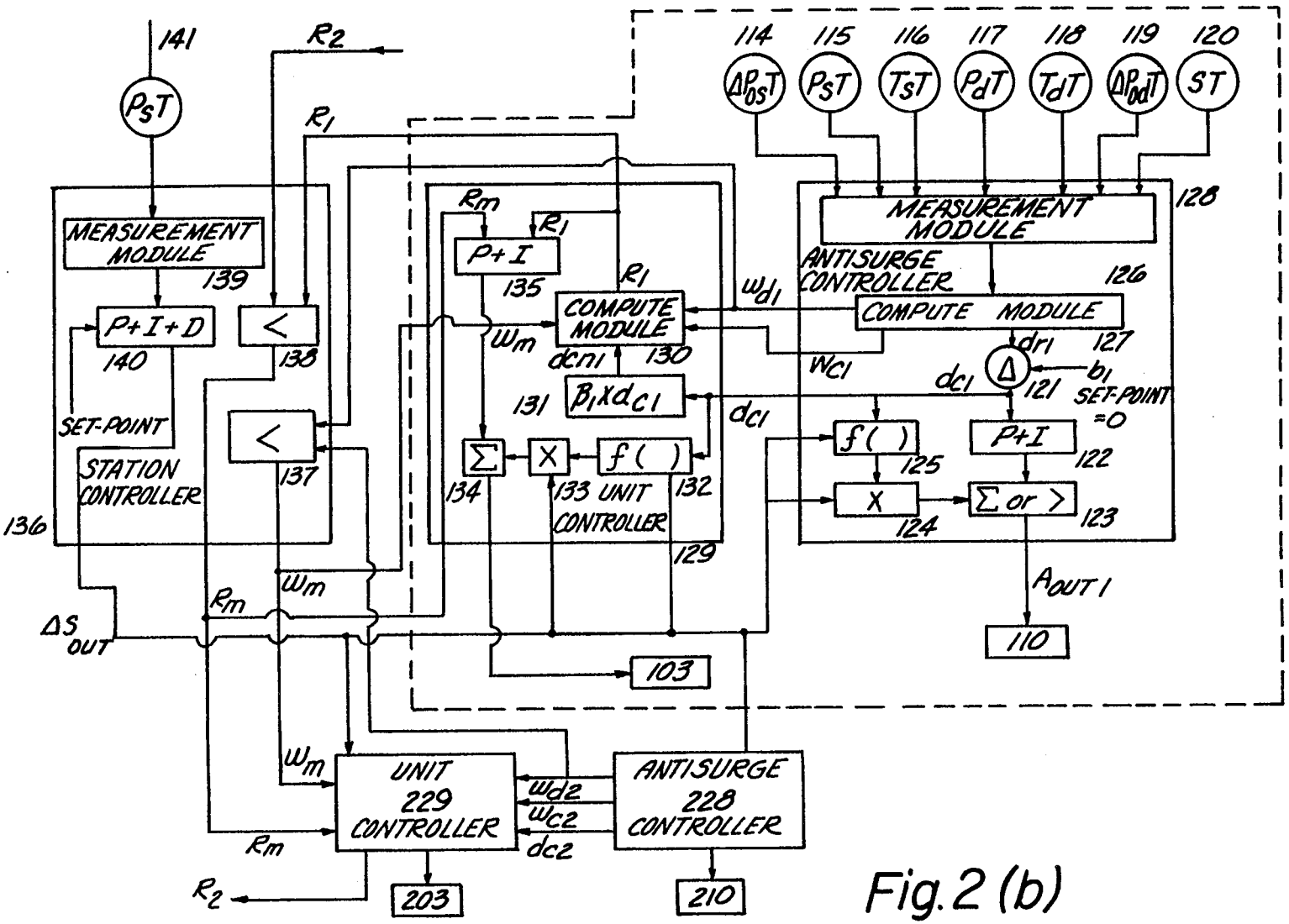

Referring now to the drawings shown in FIG. 2(*a*), the compressor station is presented in this drawing with two centrifugal compressors (101) and (201) working in series. Compressors (101) and (201) are driven by respective turbines (102) and (202) with speed governors (103) and (203), respectively. Low pressure compressor (101) receives gas from station suction drum (104) which is fed from inlet station manifold (105). Before entering drum (104), the gas is cooled by cooler (106).

High pressure compressor (201) receives gas from suction drum (204) which is fed from suction manifold (205). Before entering suction drum (204), the gas is cooled by cooler (206). There is also the sidestream flow entering manifold (205). As a result, the mass flow through high pressure compressor (201) is higher than the mass flow through low pressure compressor (101).

Each compressor is equipped with suction flow measuring device (107) for compressor (101) and (207) for compressor (201); discharge flow measuring device (108) for compressor (101) and (208) for compressor (201); non-return valves (111) and (211) located downstream of flow measurement devices (108) and (208) respectively; and recycle valve (109) for compressor (101) and (209) for compressor (201. The recycle valves are manipulated by actuators with positioners, (110) for compressor (101) and (210) for compressor (201).

Generally the minimum mass flow rate $W_m$ passing through all compressors in series, from suction manifold (105) to discharge manifold (213), is the minimum of all mass flow rates measured by the discharge flow measuring devices. Let $W_{d1}$ and $W_{d2}$ be the mass flow rates measured by discharge flow measuring devices (108) and (208), for compressors (101) and (201) respectively. Let the sidestream mass flow in sidestream manifold (212), admitted into manifold (205), be $W_{s2}$. If said sidestream mass flow rate $W_{s2}$ is positive, then mass flow is being added to manifold (205). Therefore mass flow rate $W_{d2}$ will be greater than mass flow rate $W_{d1}$, by the amount of mass flow $W_{s2}$ being added at manifold (205); and this minimum mass flow rate $W_m$ will be equal to discharge mass flow rate $W_{d1}$ for compressor (101). If sidestream mass flow rate $W_{s2}$ is negative, then mass flow is being extracted from manifold (205). In this case, mass flow rate $W_{d2}$ will be less than mass flow rate $W_{d1}$ by the amount of mass flow $W_{s2}$ being extracted at manifold (205); and minimum mass flow rate $W_m$ will be equal to discharge mass flow rate $W_{d2}$ for compressor (201).

The difference $\Delta_i$ between the minimum mass flow rate $W_m$ and the discharge mass flow rate $W_{di}$ for the $i^{th}$compressor is added upstream or downstream from the minimum flow compressor.

Each compressor is further supplied by transmitters (114), (115), (116), (117), (118), (119) and (120) for measuring differential pressure across flow element in suction (107), suction pressure, suction temperature, discharge pressure, discharge temperature, differential pressure across flow element in discharge (108), and rotational speed, respectively, for compressor (101); and transmitters (214), (215), (216), (217), (218), (219) and (220) for measuring differential pressure across flow element in suction (207), suction pressure, suction temperature, discharge pressure, discharge temperature, differential pressure across flow element in discharge (208), and rotational speed, respectively, for compressor (201).

Both compressors (101) and (201) are supplied by a station control system maintaining the pressure in suction drum (104), while sharing the common station pressure ratio between compressors (101) and (201), in an optimum way, and protecting both compressors from surge.

The station control system consists of: one common station controller (136) controlling the main process gas parameter (suction drum (104) pressure in this example) measured by pressure transmitter (141), using calculated corrective signal $\Delta S_{out}$; two unit controllers (129) and (229) for compressors (101) and (201) respectively, which control the performance of each compressor by controlling set-points $U_{out1}$ and $U_{out2}$ to speed governors (103) and (203) respectively; and two antisurge controllers (128) and (228) for compressors (101) and (201) respectively, which manipulate the set-points $A_{out1}$ and $A_{out2}$ of positioners (110) and (210) for recycle valves (109) and (209) respectively.

Referring to FIG. 2(*b*), the two identical antisurge controllers (128) and (228) for compressors (101) and (201), respectively, are each comprised of seven control modules: measuring control module (126) for machine (101) and (226) for machine (201) each receiving signals from seven transmitters (114), (115), (116), (117), (118), (119) and (120) for compressor (101), and (214), (215), (216), (217), (218), (219) and (220) for compressor (201); computational module (127) , for compressor (101) and (227) for compressor (201); proportional, plus integral control module, (122) for compressor (101) and (222) for compressor (201); comparator module (121) for compressor (101) and (221) for compressor (201); output processing module (123) for compressor (101) and (223) for compressor (201); multiplier module (124) for compressor (101) and (224) for compressor (201); and non-linear functional module (125) for compressor (101) and (225) for compressor (201).

The two unit controllers (129) and (229), for compressors, (101) and (201) respectively, are each composed of six control modules: normalizing control module (131) for compressor (101) and (231) for compressor (201); computational control module (130) for compressor (101) and (230) for compressor (201); proportional plus integral control module (135) for compressor (101) and (235) for compressor (201); summation control module (134) for compressor (101) and (234) for compressor (201); multiplier module (133) for compressor (101) and (233) for compressor (201); and non-linear functional module (132) for compressor (101) and (232) for compressor (201).

Station controller (136) is common for both compressors and is comprised of four control modules: measurement module (139) reading a signal from pressure transmitter (141), minimum criterion R selection module (138), minimum mass flow selection module (137) and proportional plus integral plus derivative control module (140).

Because antisurge controllers (128) and (228) are absolutely identical, their operation may be explained using as example antisurge controller (128). Measurement control module (126) of said antisurge controller (128) collects data from seven transmitters: differential pressure transmitter (114) measuring the pressure differential across the flow measuring device (107); suction and discharge pressure transmitters (115) and (117) respectively, suction and discharge temperature transmitters (116) and (118), respectively; the speed transmitter (120) and the differential pressure transmitter (119) measuring the pressure differential across flow measuring device (108).

Identically, with parallel operation, see equations (1) to (5), the computational module (127), based on data collected from the transmitters, computes the relative distance $d_{r1}$ of the operating point of compressor (101) from its respective surge limit line. Assuming constant gas composition, it also computes the mass flow rate $W_{c1}$ through flow measuring device (107):

$$W_{c1} = L_{c1} \cdot \sqrt{\frac{\Delta P_{os} \cdot P_s}{T_s}} \tag{8}$$

where $\Delta P_{os}$, $P_s$ and $T_s$ are read by transmitters (114), (115) and (116) respectively; and the mass flow rate $W_{d1}$ through the flow measuring device (108):

$$W_{d1} = L_{d1} \cdot \sqrt{\frac{\Delta P_{od} \cdot P_d}{T_d}} \tag{9}$$

Where $\Delta P_{od}$, $P_d$ and $T_d$ are read by transmitters (119), (117) and (118), respectively. Both computed mass flow rates $W_{c1}$ and $W_{d1}$ are directed to the computational module (130) of companion unit controller (129) for compressor (101). Mass flow rate $W_{d1}$ is also directed to minimum flow selective module (137) of station controller (136) to select minimum mass flow rate $W_m$, which passes through both compressors (101) and (201).

The computed relative distance to the respective surge limit line is directed to the comparator module (121) which produces the relative distance $d_{c1}$ of the operating point for compressor (101) to its surge control line by subtracting the safety margin $b_1$ from the relative distance $d_{r1}$:

$$d_{c1} = d_{r1} - b \tag{10}$$

This relative distance to the surge control line is directed to normalizing module (130) of unit controller (129); and to both non-linear control module (125) and P+I control module (122) of antisurge controller (128). The (P+I) control module (122) has a set-point equal to zero. It prevents distance $d_{c1}$ from dropping below a positive level by opening recycle valve (109). Recycle valve (109) is manipulated with an actuator by positioner (110) which is operated by output processing module (123) of antisurge controller (128). Said module (123) can be optionally configured as a selection module or a summation module. As a selection module (123) selects either the incremental change received from P+I module (122) or the incremental change of multiplier (124), whichever requires the larger opening of valve (109). As a summation module, the incremental changes of both P+I module (122) and multiplier module (124) are summed. Multiplier module (124) multiplies incremental change $\Delta S_{out}$ of P+I+D control module (140) of station controller (136) by nonlinear function (125) of the relative distance $d_{c1}$ and station controller incremental output $\Delta S_{out}$. This function can be either equal to value $M_{11}$, $M_{12}$ or zero. This value is equal to zero when $d_{c1} \geqq r_i$; is equal to $M_{11}$ when $d_{c1} < r_1$ and $\Delta S_{out} \geqq 0$; and is equal to $M_{12}$ when $d_{c1} < r_i$ and $\Delta S_{out} < 0$.

Unit controllers (129) and (229) are also absolutely identical, and operation of both can be sufficiently described by using the example of unit controller (129) only.

The normalizing module (131) of unit controller (129) normalizes the relative distance $d_{c1}$ to the surge control line of compressor (101) in the following way:

$$d_{cn1} = \beta_1 \cdot d_{c1} = 1 \tag{11}$$

The purpose of such normalization is to either position the operating point of compressor (101) under its maximum speed and required discharge pressure, or to position each operating point at its maximum efficiency zone under the most frequent operating conditions. This coefficient $\beta_1$ may also be dynamically defined by a higher level optimization system.

The output of normalizing module (131) of unit controller (129) together with the computed mass flows $W_{c1}$ and $W_{d1}$ received from computational module (127) of antisurge controller (128) and with the minimum discharge flow $W_m$ selected by selection control module (137) of station controller (136) enters the computational module (130). For stable optimum load-sharing between series operated compressors, it is not enough to equalize the relative distances $d_{c1}$ of compressor operating points to their respective surge control lines. It is especially important when compressors operate on their surge control lines and the relative distances $d_{c1}$ and $d_{c2}$ are equal to zero. The control system then becomes neutral and load-sharing becomes impossible. The most convenient criterion for optimum series load-sharing must consist of both: the relative distance to the surge control line and the equivalent mass flow rate, which is equal to the minimum flow passing all series working compressors from the suction manifold (105) to its discharge manifold (213). The criterion used should provide for equivalent mass flow rates through all compressors and equal distances to the respective surge control lines.

The computational control module (130) of unit controller (129) computes as such criterion, the criterion R which is defined as follows:

$$R_1 = (1 - d_{cn1})(W_{c1} - \Delta_1) \tag{12}$$

$$\text{Where } \Delta_1 = W_m - W_{d1} \tag{13}$$

The minimum discharge mass flow rate $W_m$ is selected by flow selection module (137) of station controller (136) from mass flow rates $W_{d1}$ and $W_{d2}$ computed for compressors (101) and (201), respectively. In the system shown in FIG. 2(*a*), with sidestream mass flow rate $W_{s2}$ positive, $W_{d1}=W_m$ and for compressor (101) $\Delta_1=0$. But for compressor (201), the value $\Delta_2$ is positive and $R_2=(1-d_{cn2})(W_{c2}-\Delta_2)$ (14)

The output $R_1$ of computational module (130) is directed to P+I control module (135) of unit controller (129) as the process variable, and to selection module (138) of station controller (136). Selection module (138) of station controller (136) selects $R_m$, the lowest criterion R value from the outputs of computational control modules (130) and (230) of compressors (101) and (201) respectively. The selected lowest criterion $R_m$ is used as a set-point for the proportional plus integral control modules (135) and (235) of the respective unit controllers.

For one of the two P+I modules (135) and (235), the criterion $R_i$ process variable is equal to the set-point $R_m$. The output of this P+I control module is therefore not changing. If $R_1 \neq R_2$, the output of the other P+I module will however be changing to equalize the criterion R values.

If, as in this example, compressor (101) is selected as the leader, changes of the output of the summation control module (134) of unit controller (129) will be based only on the incremental changes of the output of P+I+D control module (140) of station controller (136). Station controller (136), by means of nonlinear control function (132), of unit control means (129), exactly as it was described for the parallel operation, can decrease or increase the output of the summation module (133) only if the relative distance $d_{c1}$ of the operating point of compressor (101) to its surge control line is greater than or equal to the preset level "$r_1$." When $d_{c1}<0$, P+I+D module (140) can only increase the output of module (134).

In the case when criterion $R_2$ is lower than criterion $R_1$, compressor (201) is selected as the leader. In such a case, the changes of the output of summation control module (134) are based on changes of the output of P+I control module (135) and on incremental changes of the output of P+I+D control module (140). As a result, the speed of compressor (101) is corrected to equalize the computed criterion $R_1$ value with the selected minimum criterion $R_m=R_2$, Equalizing criterion R values in the case when the recycle valves (109) and (209) are closed provides automatically for equalizing the relative distances $d_{c1}$ and $d_{c2}$ also, because the equivalent mass flows through both compressors (101) and (201) are equal by the nature of series operation. When the operating points of both compressors are on the respective surge control lines and normalized relative distances $d_{cn1}$ and $d_{cn2}$ are kept equal to zero by antisurge controllers (128) and (129), respectively; equalizing criterion $R_1$ automatically provides for equalizing the equivalent mass flow rates through compressors (101) and (201), which in turn provides for optimum load-sharing, including the recycle load.

The operation of the system shown on FIG. 2 may be described using the following example.

Let us assume that initially compressors (101) and (201) work with speeds $N_1$ and $N_2$, respectively. Their recycle valves (109) and (209) are completely closed and the compressors are operating on equal normalized relative distances to their respective surge control lines:

$$d_{c1}=d_{c2}=a_1>0 \quad (15)$$

Therefore, both criterion values $R_1$ and $R_2$ are also equal:

$$R_1=R_2=a_2 \quad (16)$$

Also, the pressure in suction drum (104) of the compressor station is equal to the required set point, therefore $\Delta S_{out}=0$.

Assume further that the amount of flow entering suction drum (104) decreases. As a result, the suction pressure in suction drum (104) will also decrease. Since station controller (136), through incremental changes $\Delta S_{out}$ of the output of its P+I+D control module (140), will start to decrease the outputs of multipliers (133) and (233) of unit controllers (129) and (229) respectively; decreasing also the outputs of both summation modules (134) and (234) of unit controllers (129) and (229) respectively, thereby decreasing the set-points of the speed governors (103) and (203), respectively, to decrease the speed of both compressors. Assume also that as soon as the speeds of compressors (101) and (201) start to decrease, the criterion $R_2$ becomes greater than criterion $R_1$. Then selection control module (138) of station controller (136) selects $R_1$ as a set-point $R_m$ for both P+I control modules (135) and (235) of respective unit controllers (129) and (229). The output of P+I control module (135) of unit controller (129) for compressor (101) will not be changing and the summation control module (134) will decrease its output only under the influence of the output of P+I+D control module (140) of station controller (136). On the contrary, the output of the P+I control module (235) of compressor (201) increases to partially compensate for the incremental decrease of the output of P+I+D control module (140), in order to equalize criterion $R_2$ with the criterion $R_1$.

This process continues until the pressure on suction drum (104) is restored to the required level and both criterion $R_1$ and criterion $R_2$ are equalized.

Assume further that there is a continuous decrease of the flow supply to suction drum (104), and the operation of the control system shown in FIG. 2 brings the operating points of both compressors to their respective surge control lines; which means that $d_{c1}=d_{c2}=0$. If, under the above circumstances the pressure in suction drum (104) is still lower than required, then station controller (136) through its P+I+D control module (140) further decreases the distances $d_{c1}$ and $d_{c2}$ until both of them are equal to the preset levels "$r_1$" and "$r_2$," respectively. Simultaneously, the antisurge controllers (128) and (228) will start to open the recycle valves (109) and (209).

If the suction pressure continues to drop P+I+D control module (140) of station controller (136) will override the antisurge controllers (128) and (228) to open the recycle valves even more to restore the suction pressure to the required level. As soon as the distances $d_{c1}$ and $d_{c2}$ become higher than their respective preset levels "$r_1$" and "$r_2$," station controller (136) through the summation units (134) and (234) of respective unit controllers will decrease the compressor speeds. This process will continue until the suction pressure is at the required level; and the respective criterion R values for both compressors are equal, thereby optimally sharing the compression load.

We claim:

1. A method of controlling a compressor station pumping gas from a process located upstream from said station to a process located downstream from said station, said compressor station including a plurality of parallel working dynamic compressors; each of said compressors being operated by a unit final control means for changing the compressor performance; said compressor station being also equipped with a station control system for adjusting the station performance to demands of both said upstream and downstream processes in order to maintain a main process gas parameter, said station control system consisting of a station control means for controlling said main process gas parameter; unit control means, one for each compressor, for operating said unit final control means; and antisurge control means, one for each compressor, for computing a relative distance between a compressor operating point and a respective surge limit, and preventing said relative distance from decreasing below some predetermined minimum level by opening an antisurge final control means, said method comprising:

developing a corrective change of the output of said station control means to prevent a deviation of said main process gas parameter from its required level;

computing for each individual compressor a normalized relative distance to a surge control line, said normalized distance being equal to zero at the moment when said relative distance of compressor operating point from the respective surge limit becomes equal to said predetermined minimum level, selecting among said normalized relative distances to the respective surge control lines of parallel working compressors the highest normalized relative distance;

operating said unit final control means of the compressor with the highest normalized relative distance to its surge control line by a scaled corrective change of the output of said station control means to restore said main process gas parameter to the required level;

developing a unit corrective signal for each individual compressor to equalize its normalized relative distance to the respective surge control line with said selected highest normalized relative distance; and operating said unit final control means for each individual compressor, which normalized relative distance to the respective surge control line is shorter than said selected highest normalized relative distance, by combination of the scaled changes of the output of said station control means and said unit corrective signal whereby said process parameter is restored to the required level and said normalized relative distance to the compressor surge control line is equalized with the selected highest normalized relative distance.

2. A method of controlling a compressor station pumping gas from a process located upstream from said station to a process located downstream from said station;

said compressor station consisting of a plurality of dynamic compressors working in series, each of which being operated by a unit final control means for changing the compressor performance;

said compressor station being also equipped with a station control system adjusting the station performance to demands of both said upstream and downstream processes in order to maintain a main process gas parameter; said station control system consisting of a station control means controlling said station main process gas parameter; unit control means, one for each compressor, operating said unit final control means; and antisurge control means, one for each compressor, computing a relative distance between a compressor operating point and a respective surge limit, and preventing said distance from decreasing below some predetermined minimum level by opening an antisurge final control means, said method comprising:

developing a corrective change of the output of said station control means to prevent a deviation of said main process gas parameter from its required level;

computing for each individual compressor a normalized relative distance to a surge control line, said normalized distance being equal to zero at the moment when said relative distance of compressor operating point from the respective surge limit become equal to said predetermined minimum level;

computing for each compressor a mass flow rate $W_c$ of gas flowing through the compressor and a mass flow rate $W_d$ being equal to $W_c$ less the mass flow rate of gas flowing through the antisurge final control means;

selecting among said compressors working in series the lowest mass flow rate $W_m$, among the $W_d$ for all compressors working in series, said mass flow rate representing the mass flow rate passing through all the compressors from said process located upstream from said compressor station to said process located downstream from said compressor station;

computing for each compressor a deviation A of the mass flow rate $W_d$ computed for the specific compressor from said selected minimum mass flow rate $W_m$ which passes through all compressors;

computing for each compressor a criterion R, said criterion R being equal to a product of one minus said normalized relative distance to the surge control line and a difference of said mass flow rate through the compressor $W_c$ minus said deviation $\Delta$, said difference presenting an equivalent mass flow rate through said compressor;

selecting among said criterion R for all compressors working in series the lowest criterion R;

operating said unit final control means of the compressor with the lowest criterion R by a scaled corrective change of the output of said station control means to restore said main process gas parameter to the required level;

developing a unit corrective signal for each individual compressor to equalize its criterion R with said selected lowest criterion R;

operating said unit final control means for each individual compressor which criterion R is higher than said selected lowest criterion R by combination of the scaled changes of the output of said station control means and said unit corrective signal whereby said main process gas parameter is restored to the required level and criterion R is simultaneously equalized with the selected lowest criterion R.

3. A method of controlling a main process gas parameter of a compressor station comprising a plurality of dynamic compressors working in parallel or series:

each dynamic compressor of said compressor station being operated by a unit final control means for adjusting the performance of the compressor to the demand of the process, each dynamic compressor of said compressor station also being supplied by an antisurge final control means for preventing surge;

said compressor station having a control system including:

a station control means for preventing a deviation of said main process gas parameter from its required set point; a unit control means for each compressor operating said unit final control means; and an antisurge control means for each compressor manipulating the position of said antisurge final control means, said method comprising:

calculating for each individual compressor a relative distance to its surge limit line and a relative distance to its surge control line, said relative distance to said surge control line being equal to zero when said relative distance to the respective surge limit decreases to its minimum permissible level below which said antisurge control means starts to open said antisurge final control means;

calculating for each individual compressor two functions from said relative distance to the respective surge control line; said first function being applied to said unit final control means and being equal to a constant $M_1$ when said relative distance from said surge control line is higher than or equal to a predetermined level "r", and when said relative distance is lower than "r" but control of the main process gas parameter requires to increase the compressor performance; in all other cases said first function being equal to zero;

said second function being applied to said antisurge final control means and being equal to: constant $M_2$ when said relative distance to the respective surge control line is lower than said predetermined level "r" and the control of said main process gas parameter requires opening of said antisurge final control means; constant $M_3$, said constant $M_3$ being $<0$, when said relative distance to the respective surge control line is lower than said predetermined level "r" and the control of said main process gas parameter requires closing of said antisurge final control means; in all other cases, said second function being equal to zero;

developing a corrective change of an output of said station control means to prevent a deviation of said main process gas parameter from its required level;

multiplying for each compressor said corrective change of the output of said station control means by said first function of the relative distance to the respective surge control line and adding this value to the unit corrective signal of an output of said unit control means, said unit corrective signal equalizing said normalized relative distance to the compressor surge control line with the selected highest normalized distance, for compressors working in parallel, or equalizing respective criterion R values with the selected lowest value, for compressors working in series, and using the summation value as a set-point for a position of said unit final control means in order to control said main process gas parameter, said control being provided only when said relative distance to the respective surge control line is higher than or equal to said predetermined level "r," or when said relative distance is below "r" but said corrective change of the output of said system control means requires to increase the compressor performance; and multiplying for each compressor said corrective change of the output of said system control means by said second function of the relative distance to the respective surge control line, optionally adding this value to, or selecting the highest value in comparison with, the corrective change of an output of said antisurge control means preventing surge, and using the final value as a set-point for a position of said antisurge final control means to control said main process gas parameter when said distance to the respective surge control line is below said predetermined level "r."

4. An apparatus for controlling a compressor station pumping gas from a process located upstream from said station to a process located downstream from said station; said apparatus comprising:

a compressor station consisting of a plurality of parallel working dynamic compressors, each of which being operated by a unit final control means changing the compressor performance and an antisurge final control means for protecting the compressor from surge; said compressor station being also equipped with a station control system adjusting the station performance in order to maintain a main process gas parameter; said station control system consisting of a station control means controlling said main process gas parameter; a separate antisurge control means for controlling surge in each respective compressor, each said separate antisurge control means for controlling surge in each respective compressor computing a relative distance between a compressor operating point and a respective surge limit and preventing said relative distance from decreasing below some predetermined minimum level by controlling the antisurge final control means; a separate unit control means for each respective compressor, said unit control means operating a unit final control element to maintain said relative distance equal to that of the compressor with the largest relative distance;

said antisurge control means for each compressor including means for continuously measuring suction temperature, discharge temperature, suction pressure, discharge pressure, rotating speed, and differential pressure across a flow element in suction; continuously calculating a relative distance between the compressor operating point and respective surge control line; continuously transmitting said relative distance to the unit control means associated with the same compressor; continuously developing an antisurge corrective change based on said relative distance to the surge control line; adding the value of said antisurge corrective change to another corrective change value which is computed by multiplying a corrective change continuously received from a station control means, by a first function of said relative distance to the surge control line, said first function being continuously computed by said antisurge means; and continuously using a value which is optionally the greatest or the sum of the associated corrective changes as set-point of the position of said antisurge final control means to prevent said relative distance between the operating point and the surge limit from decreasing below a predetermined margin of safety;

said unit control means, for each compressor, continuously receiving said relative distance from surge control line from said antisurge control means for same associated compressor; continuously computing a normalized relative distance by multiplying said relative distance by a scaling constant and transmitting said normalized relative distance to said station control means; continuously receiving from said station control means a highest normalized relative distance and computing a unit control means corrective action; adding said unit control means corrective action to another corrective change value which is computed by multiplying said corrective change continuously received from said station control means, by a second function of said relative distance to the surge control line received from said antisurge control means, said second function being continuously computed by said unit control means; and continuously using the summed value of the associated corrective changes as a set-point of the position of said unit final control means, manipulating the compressor performance to restore the station main process gas parameter to its required level and to equalize said normalized relative distance to the compressor surge control line with the highest normalized relative distance received from said system control means;

said station control means for controlling the station main process gas parameter continuously measures the main process gas parameter; continuously computes the difference from a predetermined set-point limit for said main gas parameter, continuously computes a station control means corrective change; and continuously transmits said station control means corrective change to all unit control means and antisurge control means which comprise the station control system, for use by said unit control means and antisurge control means to restore the station main process gas parameter to its required set-point level; and said station control means continuously receives said normalized relative distances from unit control means for all compressors in the system; selects the highest normalized relative distance to respective surge control lines for all compressors which comprise the station, thereby selecting a leader and continuously transmits the highest normalized relative distance to all unit control means which are included in the station control system, to be used as a set-point for the unit control means in equalizing their respective normalized relative distance to their surge control lines with the highest normalized relative distance of the leader, in order to optionally share the flow load.

5. An apparatus for controlling a compressor station pumping gas from a process located upstream from said station to a process located downstream from said station; said apparatus comprising:

a compressor station consisting of a plurality of dynamic compressors working in series, each of which being operated by a unit final control means changing the compressor performance and an antisurge final control means for protecting the compressor from surge; said compressor station being also equipped with a station control system adjusting the station performance in order to maintain a main process gas parameter; said station control system consisting of a station control means controlling said main process gas parameter; antisurge control means, one for each compressor, computing a relative distance between a compressor operating point and a respective surge limit and preventing said relative distance from decreasing below some predetermined minimum level by controlling the antisurge final control means; unit control means, one for each compressor, operating a unit final control element to maintain a criterion R, representing both said relative distance and the equivalent mass flow rate through the compressor, equal to that of the compressor with the smallest criterion R value;

said antisurge control means for each compressor continuously measuring suction temperature, discharge temperature, suction pressure, discharge pressure, rotating speed, differential pressure across a flow element in suction and differential pressure across a flow element in discharge downstream of a tap off for the flow passing through antisurge final control means; continuously calculating the normalized discharge mass flow rate $W_d$ by multiplying said differential pressure across a flow element in discharge by said discharge pressure, dividing by said discharge temperature, taking the square root of the result and multiplying by a scaling constant; continuously transmitting said normalized discharge mass flow rate to said station control means, and continuously transmitting said discharge mass flow rate to said unit control means associated with said compressor; continuously calculating the normalized compressor mass flow rate $W_c$ by multiplying said differential pressure across a flow element in suction by said suction pressure, dividing by said suction temperature, taking the square root of the result, and multiplying by a scaling constant; and continuously transmitting said normalized compressor mass flow rate to said unit control means associated with said compressor; continuously calculating a relative distance between the compressor operating point and respective surge control line, continuously transmitting said relative distance to said unit control means associated with said compressor; continuously developing an antisurge corrective change based on said relative distance to the surge control line; continuously adding the value of said antisurge corrective change to another corrective change which is computed by multiplying a corrective change continuously received from a station control means, by a first function of said relative distance to the surge control line; said first function being continuously computed by said antisurge means; and continuously using a value which is optionally the greatest or the sum of the associated corrective changes as set-point of the position of said antisurge final control means to prevent said relative distance between the operating point and the surge limit from decreasing below a predetermined margin of safety;

said unit control means, for each compressor, continuously receiving said relative distance from surge control line from said antisurge control means for same associated compressor; continuously computing a normalized relative distance by multiplying said relative distance by a scaling constant; continuously receiving a minimum normalized discharged mass flow rate $W_m$ computed by said station control means and continuously transmitted to all said unit control means in the station control system; continuously computing the mass flow rate deviation $\Delta$ by subtracting said minimum normalized discharge mass flow rate $W_m$ from said normalized discharge mass flow rate $W_d$ for said compressor, continuously received from associated antisurge control means; continuously computing the equivalent mass flow rate $W_e$ by subtracting said mass flow rate deviation $\Delta$ from said normalized compressor mass flow rate $W_c$ continuously received from associated antisurge control means; continuously computing criterion R for said compressor by multiplying one minus said normalized relative distance to the surge control line by said equivalent mass flow rate $W_e$; continuously transmitting said criterion R to said station control means; continuously receiving from said station control means a lowest criterion R value $R_m$ and computing a unit control means corrective action; adding said unit control means corrective action to another corrective change value which is computed by multiplying said corrective change continuously received from said station control means, by a second function of said relative distance to the surge control line received from said antisurge control means, said second function being continuously computed by said unit control means; and continuously using the summed value of the associated corrective changes as a set-point of the position of said unit final control means, manipulating the compressor performance to restore the station main process gas parameter to its required level and to equalize said criterion R with the lowest criterion R value $R_m$ received from said station control means;

said station control means for controlling the station main process gas parameter continuously measures the main process gas parameter; continuously computes the difference from a predetermined set-point limit for said main process gas parameter, continuously computes a station control means corrective change; and continuously transmits said station control means corrective change to all unit control means and antisurge control means which comprise the station control system, for use by said unit control means and antisurge control means to restore the station main process gas parameter to its required set-point level;

said station control means continuously receives said criterion R values for all compressors in the station; selects the lowest criterion $R_m$ value among all criterion R values received from all unit control means in the station control system, thereby selecting the leader; continuously transmits said lowest criterion R value, $R_m$, to said unit control means for all compressors which comprise the station, to be used as a set-point for the unit control means in equalizing their respective criterion R values with the lowest criterion R value of the leader, in order to optionally share the compression load.

6. A method of controlling a compressor station pumping gas from a process located upstream from said station to a process located downstream from said station, said compressor station including a plurality of parallel working dynamic compressors; each of said compressors being operated by a unit final control means for changing the compressor performance; said compressor station being also equipped with a station control system for adjusting the station performance to demands of both said upstream and downstream processes in order to maintain a main process gas parameter, said station control system consisting of a station control means for controlling said main process gas parameter; unit control means, one for each compressor, for operating said unit final control means; and antisurge control means, one for each compressor, for computing a relative distance between a compressor operating point and a respective surge limit, and preventing said relative distance from decreasing below some predetermined minimum level by opening an antisurge final control means, said method comprising:

developing a corrective change of the output of said station control means to prevent a deviation of said main process gas parameter from its required level;

computing for each individual compressor a normalized relative distance to a surge control line, said normalized distance being equal to zero at the moment when said relative distance of compressor operating point from the respective surge limit becomes equal to said predetermined minimum level, selecting among said normalized relative distances to the respective surge control lines of parallel working compressors at least one of said normalized relative distances and creating a target relative distance, $d_m$, which is a function of said selected one of said normalized distances;

developing a unit corrective signal for each individual compressor to equalize its normalized relative distance to the respective surge control line with said target relative distance, $d_m$; and operating said unit final control means for each individual compressor, by combination of the scaled changes of the output of said station control means and said unit corrective signal whereby said process parameter is restored to the required level and said normalized relative distance to the compressor surge control line is equalized with the selected target relative distance, $d_m$.

7. A method of controlling a compressor station pumping a gas from a process located upstream from said station to a process located downstream from said station;

said compressor station consisting of a plurality of dynamic compressors working in series, each of which being operated by a unit final control means changing the compressor performance;

said compressor station being also equipped with a station control system adjusting the station performance to demands of both said upstream and downstream processes in order to maintain a main process gas parameter; said station control system consisting of a station control means controlling said station main process gas parameter; unit control means, one for each compressor, operating said unit final control means; and antisurge control means, one for each compressor, computing a relative distance between a compressor operating point and a respective surge limit, and preventing said distance from decreasing below some predetermined minimum level by opening an antisurge final control means, said method comprising:

developing a corrective change of the output of said station control means to prevent a deviation of said main process gas parameter from its required level;

computing for each individual compressor a normalized relative distance to a surge control line, said normalized distance being equal to zero at the moment when said relative distance of compressor operating point from the respective surge limit becomes equal to said predetermined minimum level;

computing for each compressor a mass flow rate $W_c$ of gas flowing through the compressor and a mass flow rate $W_d$ being equal to $W_c$ less the mass flow rate of gas flowing through the antisurge final control means;

selecting among said compressors working in series the lowest mass flow rate $W_m$, among the $W_d$, for all compressors working in series, said mass flow rate representing the mass flow rate passing through all the compressors from said process located upstream from said compressor station to said process located downstream from said compressor station;

computing for each compressor a deviation A of the mass flow rate $W_d$ computed for the specific compressor from said selected minimum mass flow rate $W_m$ which passes through all compressors;

computing for each compressor a criterion R, said criterion R being equal to a product of one minus said normalized relative distance to the surge control line and a difference of said mass flow rate through the compressor $W_c$ minus said deviation $\Delta$, said difference presenting an equivalent mass flow rate through said compressor;

selecting among said criterion R for all compressors working in series at least one of said criterion R and calculating a target criterion R, $R_m$, which is a function of said selected one of said criterion R;

developing a unit corrective signal for each individual compressor to equalize its criterion R with said criterion $R_m$; and operating final unit control means for each individual compressor differently by combination of the scaled changes of the output of said station control means and said unit corrective signal whereby said main process gas parameter is restored to the required level and criterion R is simultaneously equalized with the criterion $R_m$.

8. An apparatus for controlling a compressor station pumping gas from a process located upstream from said station to a process located downstream from said station; said apparatus comprising:

a compressor station consisting of a plurality of parallel working dynamic compressors, each of which being operated by a unit final control means changing the compressor performance and an antisurge final control means for protecting the compressor from surge; said compressor station being also equipped with a station control system adjusting the station performance in order to maintain a main process gas parameter; said station control system consisting of a station control means controlling said main process gas parameter; a separate antisurge control means for controlling surge in each respective compressor, each said separate antisurge control means for controlling surge in each respective compressor computing a relative distance between a compressor operating point and a respective surge limit and preventing said relative distance from decreasing below some predetermined minimum level by controlling the antisurge final control means; a separate unit control means for each respective compressor, said unit control means operating a unit final control element to maintain said relative distance equal to that of the compressor with a target relative distance;

said antisurge control means for each compressor including means for continuously measuring suction temperature, discharge temperature, suction pressure, discharge pressure, rotating speed, and differential pressure across a flow element in suction; continuously calculating a relative distance between the compressor operating point and respective surge control line; continuously transmitting said relative distance to the unit control means associated with the same compressor; continuously developing an antisurge corrective change based on said relative distance to the surge control line; adding the value of said antisurge corrective change to another corrective change value which is computed by multiplying a corrective change continuously received from a station control means, by a first function of said relative distance to the surge control line, said first function being continuously computed by said antisurge means; and continuously using a value which is optionally the greatest or the sum of the associated corrective changes as set-point of the position of said antisurge final control means to prevent said relative distance between the operating point and the surge limit from decreasing below a predetermined margin of safety;

said unit control means, for each compressor, continuously receiving said relative distance from surge control line from said antisurge control means for same associated compressor; continuously computing a normalized relative distance by multiplying said relative distance by a scaling constant and transmitting said normalized relative distance to said station control means; continuously receiving from said station control means a target normalized relative distance and computing a unit control means corrective action; adding said unit control means corrective action to another corrective change value which is computed by multiplying said corrective change continuously received from said station control means, by a second function of said relative distance to the surge control line received from said antisurge control means, said second function being continuously computed by said unit control means; and continuously using the summed value of the associated corrective changes as a set-point of the position of said unit final control means, manipulating the compressor performance to restore the station main process gas parameter to its required level and to equalize said normalized relative distance to the compressor surge control line with the target normalized relative distance received from said system control means;

said station control means for controlling the station main process gas parameter continuously measures the main process gas parameter; continuously computes the difference from a predetermined set-point limit for said main process gas parameter, continuously computes a station control means corrective change; and continuously transmits said station control means corrective change to all unit control means and antisurge control means which comprise the station control system, for use by said unit control means and antisurge control means to restore the station main process gas parameter to its required set-point level; and said station control means continuously receives said normalized relative distances from unit control means for said compressors in the system; selecting at least one of said normalized relative distances and creating a target relative distance which is a function of said selected one of said normalized distances and continuously transmits the target normalized relative distance to all unit control means which are included in the station control system, to be used as a set-point for the unit control means in equalizing their respective normalized relative distance to their surge control lines with the target normalized relative distance, in order to optionally share the flow load.

9. An apparatus for controlling a compressor station pumping gas from a process located upstream from a station to a process located downstream from said station; said apparatus comprising:

a compressor station consisting of a plurality of dynamic compressors working in series, each of which being operated by a unit final control means changing the compressor performance and an antisurge final control means for protecting the compressor from surge; said compressor station being also equipped with a station control system adjusting the station performance in order to maintain a main process gas parameter; said station control system consisting of a station control means controlling said main process gas parameter; antisurge control means, one for each compressor, computing a relative distance between a compressor operating point and a respective surge limit and preventing said relative distance from decreasing below some predetermined minimum level by controlling the antisurge final control means; unit control means, one for each compressor, operating a unit final control element to maintain a criterion R equal to a target criterion R, $R_m$;

said antisurge control means for each compressor continuously measuring suction temperature, discharge temperature, suction pressure, discharge pressure, rotating speed, differential pressure across a flow element in suction and differential pressure across a flow element in discharge downstream of a tap off for the flow passing through antisurge final control means; continuously calculating the normalized discharge mass flow rate $W_d$by multiplying said differential pressure across a flow element in discharge by said discharge pressure, dividing by said discharge temperature, taking the square root of the result and multiplying by a scaling constant; continuously transmitting said normalized discharge mass flow rate to said station control means, and continuously transmitting said discharge mass flow rate to said unit control means associated with said compressor; continuously calculating the normalized compressor mass flow rate $W_c$ by multiplying said differential pressure across a flow element in suction by said suction pressure, dividing by said suction temperature, taking the square root of the result, and multiplying by a scaling constant; and continuously transmitting said normalized compressor mass flow rate to said unit control means associated with said compressor; continuously calculating a relative distance between the compressor operating point and respective surge control line, continuously transmitting said relative distance to said unit control means associated with said compressor; continuously developing an antisurge corrective change based on said relative distance to the surge control line; continuously adding the value of said antisurge corrective change to another corrective change which is computed by multiplying a corrective change continuously received from a station control means, by a first function of said relative distance to the surge control line; said first function being continuously computed by said antisurge means; and continuously using a value which is optionally the greatest or the sum of the associated corrective changes as set-point of the position of said antisurge final control means to prevent said relative distance between the operating point and the surge limit from decreasing below a predetermined margin of safety;

said unit control means, for each compressor, continuously receiving said relative distance from surge control line from said antisurge control means for same associated compressor; continuously computing a normalized relative distance by multiplying said relative distance by a scaling constant; continuously receiving a minimum normalized discharged mass flow rate $W_m$ computed by said station control means and continuously transmitted to all said unit control means in the station control system; continuously computing the mass flow rate deviation $\Delta$ by subtracting said minimum normalized discharge mass flow rate $W_m$ from said normalized discharge mass flow rate $W_d$ for said compressor, continuously received from associated antisurge control means; continuously computing the equivalent mass flow rate $W_c$ by subtracting said mass flow rate deviation $\Delta$ from said normalized compressor mass flow rate $W_c$ continuously received from associated antisurge control means; continuously computing criterion R for said compressor by multiplying one minus said normalized relative distance to the surge control line by said equivalent mass flow rate $W_e$; continuously transmitting said criterion R to said station control means; continuously receiving from said station control means said target criterion R, $R_m$, and computing a unit control means corrective action; adding said unit control means corrective action to another corrective change value which is computed by multiplying said corrective change continuously received from said station control means, by a second function of said relative distance to the surge control line received from said antisurge control means, said second function being continuously computed by said unit control means; and continuously using the summed value of the associated corrective changes as a set-point of the position of said unit final control means, manipulating the compressor performance to restore the station main process gas parameter to its required level and to equalize said criterion R with the target criterion R, $R_m$, received from said station control means;

said station control means for controlling the station main process gas parameter continuously measures the main process gas parameter; continuously computes the difference from a predetermined set-point limit for said gas parameter, continuously computes a station control means corrective change; and continuously transmits said station control means corrective change to all unit control means and antisurge control means which comprise the station control system, for use by said unit control means and antisurge control means to restore the station main process gas parameter to its required set-point level;

said station control means continuously receives said criterion R values from said unit control means in the station control system; selects at least one of the criterion R among all criterion R received from said unit control means in the station control system and calculate a target criterion R, $R_m$, which is a function of said selected one of said criterion R; continuously transmits said target criterion R, $R_m$, to all of said unit control means in said station control system, to be used as a set-point for the unit control means in equalizing their respective criterion R with the target criterion R, $R_m$, in order to optionally share the compression load.

* * * * *